US005454445A

United States Patent [19]

Berryman

[11] Patent Number: 5,454,445

[45] Date of Patent: Oct. 3, 1995

[54] OBSERVATION AND HUNTING STAND

[76] Inventor: Larry O. Berryman, P.O. Box 935, Hallsville, Tex. 75650

[21] Appl. No.: 196,997

[22] Filed: Feb. 14, 1994

Related U.S. Application Data

[63] Continuation of Ser. No. 879,203, May 6, 1992, abandoned.

[51] Int. Cl.[6] ..... E06C 1/12

[52] U.S. Cl. ..... 182/116; 182/100

[58] Field of Search ..... 182/187, 100, 182/116, 43

[56] References Cited

U.S. PATENT DOCUMENTS 4,257,490 3/1981 Banay ..... 182/187 X
4,263,893 4/1981 Norton ..... 182/100 X
4,411,335 10/1983 Forrester ..... 182/187
4,552,246 11/1985 Thomas ..... 182/116
4,592,446 6/1986 White ..... 182/116 X
4,648,483 3/1987 Skyba ..... 182/187

*Primary Examiner*—Alvin C. Chin-Shue
*Attorney, Agent, or Firm*—Charles C. Garner

[57] ABSTRACT

An elevated observation stand is made in the form of a tubular ladder member with an eccentrically mounted seat and platform at the upper end, extending obliquely for safe access. A strap, engaged and tightened from the ground, binds the tubular ladder member to a tree at mid-span with sufficient force that the resulting friction supports the platform under load.

13 Claims, 3 Drawing Sheets

OBSERVATION AND HUNTING STAND

This application is a continuation of application 07/879,203 filed May 6, 1992, now abandoned as result of this continuation.

FIELD OF THE INVENTION

The present invention relates to the field of elevated stands for hunters and photographers and most particularly, such devices having a ladder which is bound to a tree for primary support.

BACKGROUND AND SUMMARY OF THE INVENTION

There have been numerous efforts to provide a workable, easily erected tree stand for hunters and photographers. Prior art teaches that these devices should be made as an assembly which is unfolded for field erection in the manner of Lee, U.S. Pat. No. 4,787,476, Bandy, U.S. Pat. No. 4,257,490 or White, U.S. Pat. No. 4,592,446. Portability is certainly a virtue, to which packaging contributes, but when carrying the unit for any distance, weight is a more significant factor. The reality is, that a configuration which depends upon a significant degree of field assembly will generally be heavier and more expensive as a result. While a measure of portability is needed, ease and versatility of erection are actually more important. Moreover, the complexity of adjustable, loose or folding parts reduces durability and increases costs.

Safety in use is a more important consideration than package size. A stand must provide safe access to a stable sitting or standing observation perch. Typically, the prior art teaches a ladder, which may be strapped to the tree, having a seat or small platform at the top which is separately secured to the tree. The user is exposed to an obvious risk when he must secure the seat to the tree trunk while standing on a minimal ladder. In addition, most property owners value their trees, sometimes as an ecological consideration, sometimes as a cash crop, and a hunter who scars a tree with his stand risks loss of future access to the location. Thus, stabilizing the stand with picks or teeth that penetrate the bark of the tree will detract from its utility.

A first object of the present invention is therefore to provide a stand which can be readily and safely secured to virtually any size tree without climbing. A second object is that when secured, this stand must be stable and safe to ascend for use in either a sitting or standing position, and that this stability must not be at the expense of a mutilated tree. A third object of the invention is that portability and low cost, hence ultimate marketability, are not sacrificed to achieve utility.

In achieving these objects, the present invention uses a tubular member as ladder but departs from prior teachings in the structural application of this same member as both a beam and a column. The tubular member is erected adjacent to a stationary entity such as a tree, utility pole or the like and is secured tightly at mid-span and only at mid-span. The securing means must be a type appropriate for high-tension applications with a lever handle to provide mechanical advantage for tensioning. The high tension causes a portion of the length of the tubular member to be preloaded against the tree surface with a force sufficient to provide absolute stability under all normal loading conditions. The tubular member deflects locally under the force, and the surface of the tree compresses, forming a loaded contact patch large enough to support the portion extended above the strap.

Trees typically bell out somewhat near ground level so that the member must deflect to match the concave profile, or the member may be secured to a utility pole having a virtually straight profile. The member may also be placed in a raised position so that its lower end is unsupported. In any case, the preload force is applied over an area large enough that there is no surface penetration or damage.

The ladder length can be such as to fit in a pick-up truck bed with the mid-span strap attachment placed at a level readily reachable from the ground. Welded steel tubular construction gives a finished stand assembly weighing approximately 40 pounds, and less using aluminum, so that it is easy to carry and erect. The tubular member can also be made with a moment bearing joint, for a more convenient package length, with only a minor weight penalty and no significant functional compromise.

DESCRIPTION OF THE DRAWINGS

The aforementioned and other objects and features of the invention will be apparent from the following detailed description of specific embodiments thereof, when read in conjunction with the accompanying drawings, in which.

DETAILED DESCRIPTION OF THE INVENTION

Figure 1:
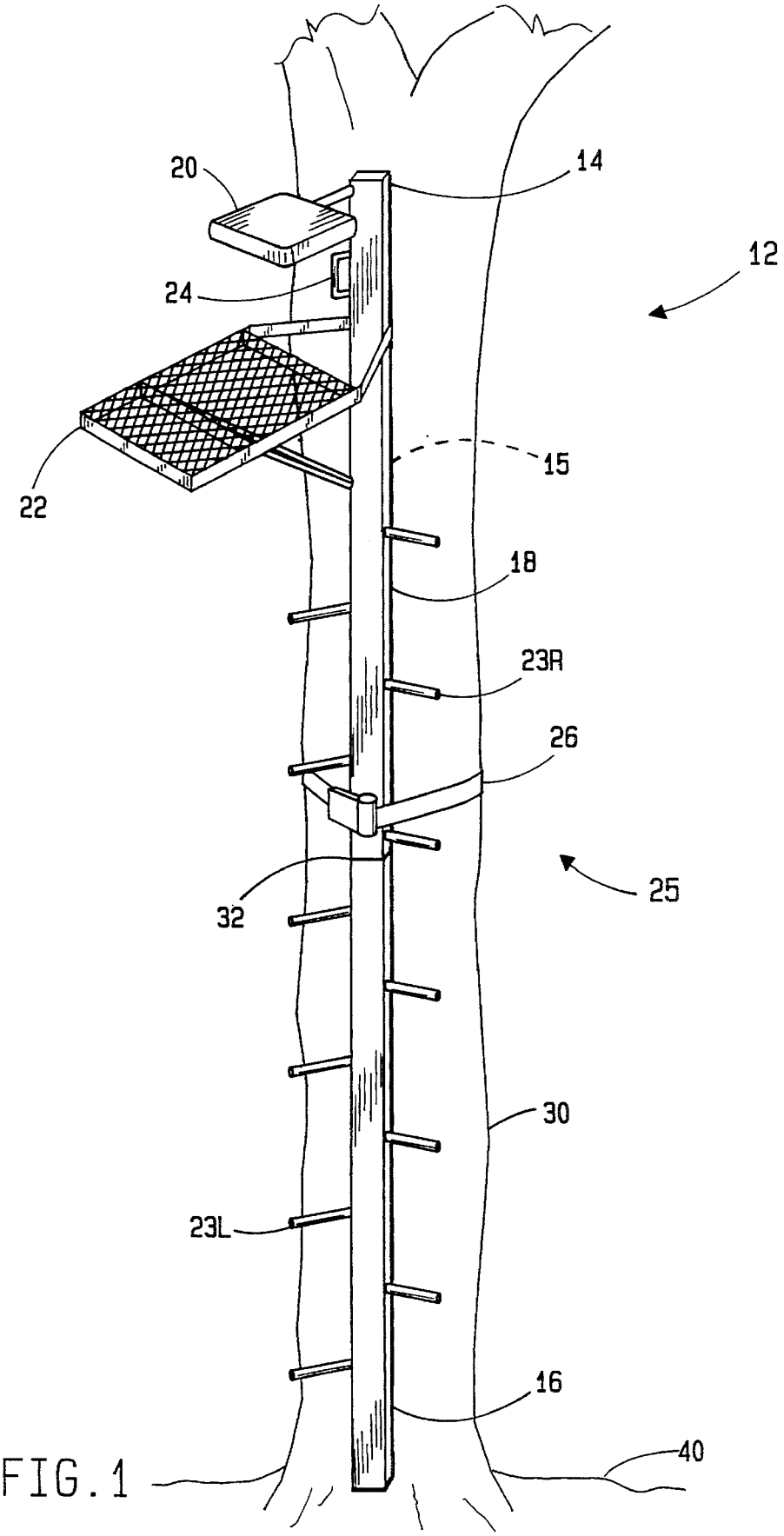
FIG. 1 is a view showing a preferred embodiment of the present invention affixed to a tree.

In FIG. 1 is shown a preferred embodiment 10 of the present invention as installed on a typical tree. Tubular member 12 is seen to comprise an upper portion 14, a lower portion 16, and a mid-span portion 18. In this embodiment, tubular member 12 is made of square by 0.078" wall steel tubing which has been found to have suitable properties of strength, stiffness and weight for the application. The hidden reference surface 15 is shown to be held tightly against the tree 30 by binding means 25 which include strap 26. It will be appreciated that installation on a utility pole or any similar stationary entity is also feasible. Substantially horizontal seat 20 and a platform 22 are eccentrically mounted to upper portion 14 at an oblique angle with respect to reference surface 15. It will be noted that right and left foot supporting elements 23L and 23R are mounted to tubular member 12 in an ladder arrangement so that a person climbing to platform 22 will follow a central path with respect to reference surface 15. Being obliquely offset from the ladder path in this manner, platform 22 is made easily accessible and hand grip 24 is provided to further enable a safe transition.

Binding means 25 is tightly tensioned so that reference surface 15 is pressed against the surface of tree 30 with considerable force. Platform 22 is of a size that would allow a 250 pound man to stand with his weight centered approximately 26" away from reference surface 15. It can readily be shown that the 6,250 lb-in bending moment thus imposed upon tubular member 12 is well within safe limits. It can also be shown that, with an assumed coefficient of friction of 0.5 and a binding tension of 4,000 lbs., platform 22 is adequately stabilized by an 8" long contact patch. In normal use, tubular member 12 contacts tree 30 over a much greater length, so that less tension is actually needed. When the tree profile is somewhat concave, so as to establish an even longer contact patch, or when lower end portion 16 is pressed into contact with ground 40, the tension requirement is further reduced.

Figure 2:
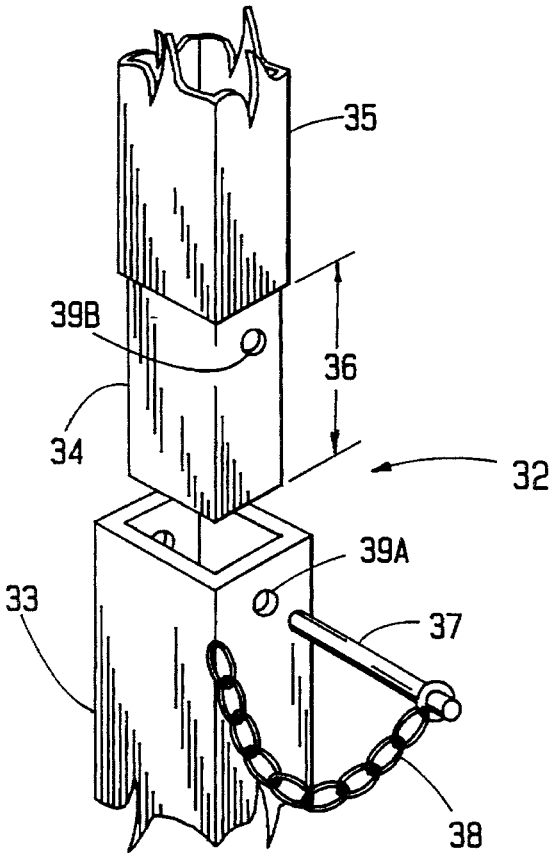
FIG. 2 is a detail view showing a construction of the mid-span portion of the tubular member of FIG. 1 with a demountable joint.

An optional moment bearing joint 32 may be included in the mid-span portion 18 so that tubular member 12 may be broken down for portability. This feature is not essential to the invention, but is an attractive enhancement for some users. A detailed view of moment bearing joint 32 is shown in FIG. 2 where it is seen to be made for telescoping assembly. Reduced section 34, sized for a close fit, acts as a fixed extension to upper section 35 of tubular member 12 and engages lower section 33 thereof. The length 36 of reduced section 34 is sufficient to carry bending moments such as are imposed on tubular member 12. The friction of the close fit of section 34 within lower section 33 keeps moment bearing joint 32 together during installation. As binding means 25 is tightened, the consequential bending forces increase this retaining friction greatly but, for absolute safety, retaining pin 37 is inserted through matching pin holes 39A and 39B in lower section 33 and reduced section 34 respectively. Retaining pin 37 is attached to lower section 33 by chain 38 so as to be readily at hand.

Figure 3:
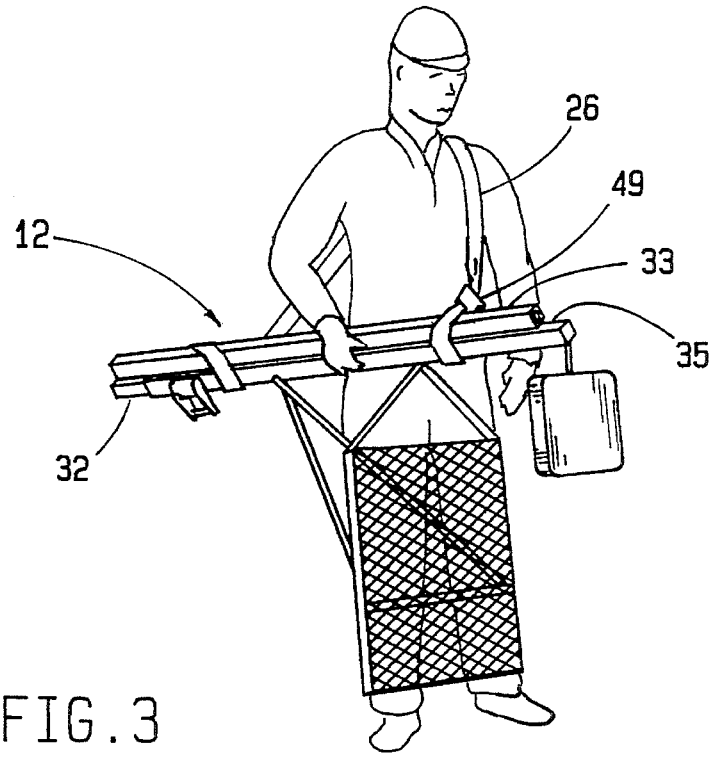
FIG. 3 shows the manner in which the present invention may be carried.

FIG. 3 shows how the moment bearing joint 32 permits demounting of tubular member 12 so that upper section 35 and lower section 33 can be carried as an adjacent, parallel package held by strap 26. Hook attachment 49 hooks back onto strap 26 which then serves as a sling.

Figure 4:
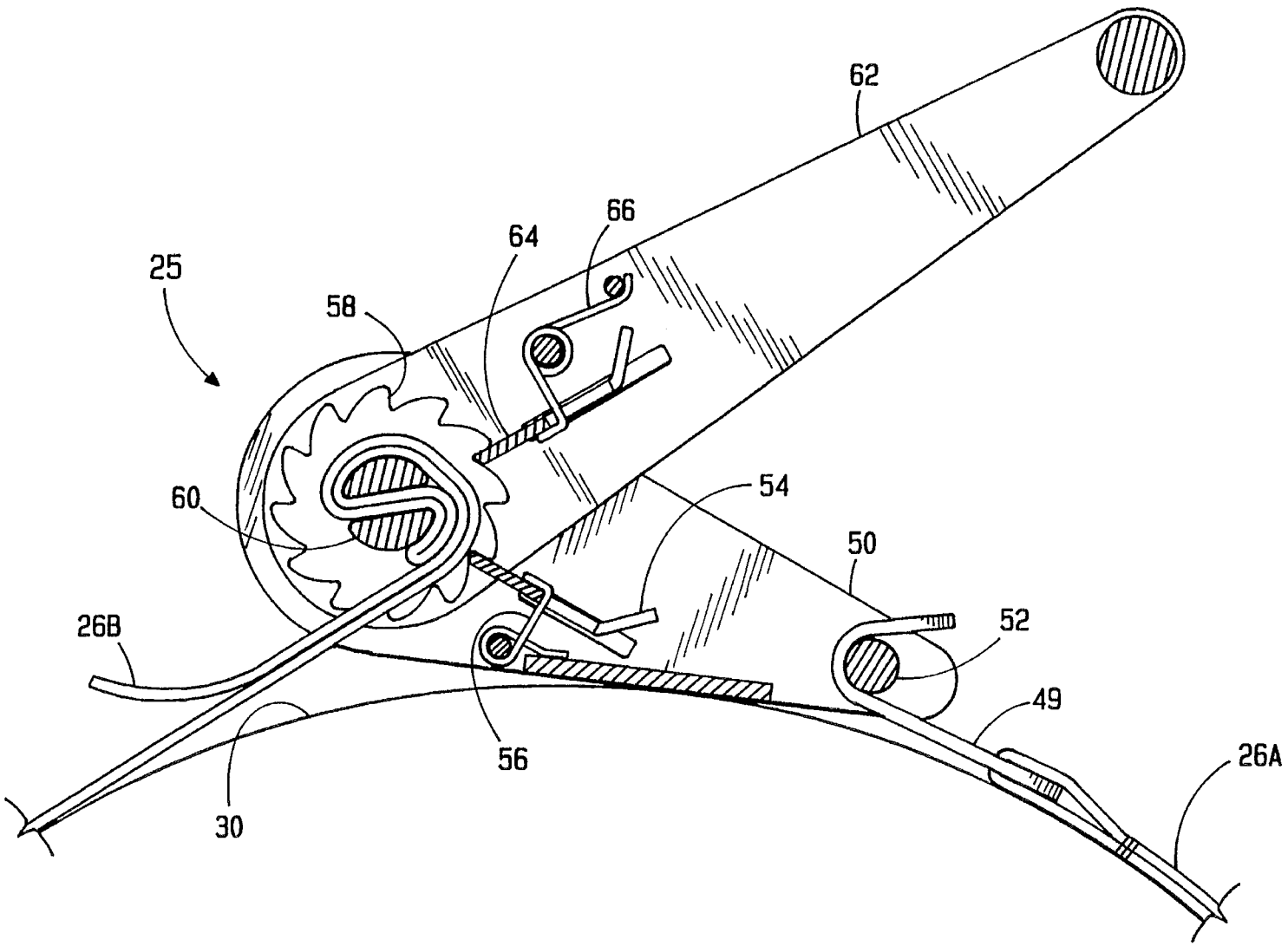
FIG. 4 is a detail view showing the binding means of FIG. 1.

FIG. 4 depicts the workings of binding means 25 which, in this embodiment comprises an assembly normally used for cargo tie-down applications by freight handlers. Binder frame 50 is seen to be placed against tree 30 with strap 26 passing thereabout. Strap end 26A is secured to hook attachment 49 and strap end 26B is doubled over and passed through split pin 60. Binder frame 50 includes anchor pin 52 to which hook attachment 49 is latched. Split pin 60, along with ratchet 58, are a sub-assembly which is rotatably mounted within binder frame 50 and normally locked from doing so by spring 56 and the engagement of safety pawl 54. Spring 66 urges tensioning pawl 64 into engagement with ratchet 58 so that tensioning lever 62 can rotate split pin 60 for tightening strap 26.

It is to be understood that the present invention is not limited to the disclosed embodiment, but is fully capable of rearrangement, modification and substitution of parts within the spirit of the invention.

I claim:

1. A portable observation platform and ladder assembly removably affixed to a stationary entity such as a tree or the like to provide an elevated surveillance position for at least one person comprising:

a portable column member having upper and lower end portions, a mid-span portion, and a contact surface on said mid-span portion for contacting a stationary entity;

a plurality of right and left foot supporting elements on said column member in an ascending ladder arrangement;

platform means mounted on said column member at the upper end portion thereof for supporting at least one person;

means for securing said observation platform and ladder assembly on said stationary entity;

said securing means consisting of not more than a single means for binding said column member to said stationary entity at said contact surface of said mid-span portion;

said binding means providing preloaded frictional support for said observation platform and ladder assembly including said at least one person located on said platform; and wherein said platform means further comprises;

a substantially horizontal platform eccentrically mounted to said upper end portion of said column member so as to extend obliquely in a horizontally oblique angle with respect to the plane of said contact surface; and a substantially horizontal seat support arranged above and substantially aligned with said platform.

2. A portable observation platform and ladder assembly according to claim 1 wherein said foot supporting elements are placed to establish a platform entry path substantially offset from said obliquely extending seat and platform.

3. A method of removably installing an elevated observation platform and ladder assembly for use on a stationary entity such as a tree comprising the steps of:

erecting said observation platform and ladder assembly adjacent to a stationary entity so that a contact surface of said assembly is in contact with said entity;

securing said assembly to said entity wherein said step of securing consists the steps of:

passing not more than a single strap around a mid-span portion of said assembly and about said entity so that said contact surface is bound into contact therewith; and tightening said strap from the ground while unsupported by said assembly or by said entity, so that frictional forces between said contact surface and said entity are adequate to support the normal usage loads imposed by an observer located on said platform; and wherein said step of erecting further comprises erecting said assembly with said platform eccentrically mounted on the upper end portion of said ladder assembly, off-set at a horizontally oblique angle with reference to the plane of said contact surface.

4. A portable observation platform, seat and ladder assembly for attachment to a stationary entity such as a tree, or the like, comprising:

a portable tubular member;

a plurality of right and left foot supporting elements on said member in ascending ladder order;

platform and seat means mounted on the upper end portion of said member for supporting at least one person;

said platform and seat means located at a height above the ordinary reach of a person from the ground, when said assembly is attached to said stationary entity in a vertical position;

means for attaching said assembly to said entity;

said attaching means located at midspan only of said assembly;

said attaching means consisting of not more than a single binding means for applying preloaded, high tension binding force between said member and said entity;

said single binding means comprising sole and total means for securing said assembly to said entity including said person located on said platform and seat;

said single binding means, when said assembly is vertically secured to said entity, located at a height manually reachable and operable by a person standing on the ground, wherein said assembly can be vertically erected and secured to said entity without climbing;

said high tension binding force applied over an area of said entity large enough that there is no surface penetration of said entity;

said platform and seat means further comprising;

a substantially horizontal platform eccentrically mounted on said upper end portion of said tubular member so as to extend obliquely off-set to one side and out of the path of a person climbing up said right and left ladder foot supporting elements on said member; and a horizontal seat support arranged above and substantially aligned with said platform.

5. An assembly according to claim 4 wherein said foot supporting elements are placed to establish a platform entry path substantially offset from said obliquely extending seat and platform means.

6. A portable hunting observation device for attachment to a tree trunk, which provides total support on said tree for an eccentrically mounted observation platform including observer located at a height above manual reach of an average person from the ground, using a single binding strap only, and which can be erected and secured to said tree without climbing, comprising:

An elongated structural member for vertically oriented placement against the trunk of a tree, said member having an upper end, a lower end, and a midspan portion;

A plurality of right and left foot supporting elements on said member in ascending ladder order;

Substantially horizontal platform means, eccentrically mounted on said member proximate said upper end so as to extend obliquely in a horizontally oblique angle off-set to one side and out of the path of an observer climbing up said right and left foot supporting elements, for supporting an observer at a height above manual reach of an average person from the ground;

Means on said member for totally supporting and maintaining vertical alignment of said device and said eccentrically mounted platform means on said tree including said observer at said height;

Said means for totally supporting and maintaining vertical alignment consisting of;

A single strap and ratchet assembly for binding said member to said tree;

Said assembly comprising means for creating frictional forces between said member and said tree sufficient to overcome displacement forces incident to use of said device for supporting said observer on said platform at said height; and Said assembly located in said midspan portion and at a height manually operable by a person from the ground wherein said device can be erected and secured to said tree without climbing.

7. A device according to claim 6 further comprising said binding strap and said elongated structural member wide enough that said device causes no surface penetration of said entity.

8. A device according to claim 6 wherein said elongated structural member comprises:

an upper member section; and a lower member section telescopically joined to said upper member section as a demountable extension thereof.

9. A device according to claim 8 further comprising means for employing said binding strap as a sling to carry said demounted upper and lower member sections in a parallel and adjacent relationship.

10. A portable hunting observation device for attachment to a stationary entity, such as a tree, which provides sole support on said tree, without bearing on the ground, for an eccentrically mounted observation platform and observer located at a height above manual reach of an average person from the ground, using a single binding strap only, and which can be erected and secured to said tree without climbing, comprising:

A portable elongated structural member for vertically oriented placement against the trunk of a tree;

Said member having an upper end, a lower end, and a midspan portion;

A plurality of right and left foot supporting elements on said member in ascending ladder order;

Eccentrically mounted platform means, eccentrically mounted on said member proximate said upper end so as to extend obliquely in a horizontally oblique angle off-set to one side and out of the path of an observer climbing up said right and left foot supporting elements, for supporting an observer at a height above manual reach of an average person from the ground;

Means on said member for totally supporting and maintaining vertical alignment of said device on said tree including said observer on said platform at said height with said lower end in a raised position not bearing on the ground;

Said means for totally supporting and maintaining vertical alignment consisting of:

A single strap and ratchet assembly for binding said member to said tree;

Said assembly comprising means for creating frictional forces between said member and said tree sufficient to overcome displacement forces incident to use of said device for supporting said observer on said platform at said height with said member placed in a raised position so that said lower end is unsupported by the ground; and Said assembly located in said midspan portion and at a height manually operable by a person standing on the ground wherein said device can be erected and secured to said tree without climbing.

11. A device according to claim 10 further comprising said binding strap and said elongated structural member wide enough that said device causes no surface penetration of said entity.

12. A device according to claim 10 wherein said elongated structural member comprises:

an upper member section; and a lower member section telescopically joined to said upper member section as a demountable extension thereof.

13. A device according to claim 12 further comprising means for employing said binding strap as a sling to carry said demounted upper and lower member sections in a parallel and adjacent relationship.

* * * * *